United States Patent [19]

Lorrek et al.

[11] 4,333,910

[45] Jun. 8, 1982

[54] ARRANGEMENT FOR DISCHARGING COKE FROM A COOLING SHAFT SUPPLIED WITH COOLING GAS

[75] Inventors: Johannes Lorrek; Friedrich Jokisch, both of Essen, Fed. Rep. of Germany

[73] Assignee: Krupp-Koppers GmbH, Essen, Fed. Rep. of Germany

[21] Appl. No.: 225,969

[22] Filed: Jan. 14, 1981

[30] Foreign Application Priority Data

Jan. 31, 1980 [DE] Fed. Rep. of Germany ..... 3003345

[51] Int. Cl.[3] ..... B01F 7/16

[52] U.S. Cl. ..... 422/228; 15/236 C; 134/104; 202/241; 366/261; 366/285

[58] Field of Search ..... 422/228, 225; 366/261, 366/285, 307; 62/303; 202/241; 15/363, 236 C; 134/104

[56] References Cited

U.S. PATENT DOCUMENTS

| | | | |
|---|---|---|---|
| 668,297 | 2/1901 | Powter | 422/228 X |
| 1,279,515 | 9/1918 | Coleman | 366/285 |
| 1,854,731 | 4/1932 | Beran | 366/285 X |
| 3,156,541 | 11/1964 | Kalke | 366/261 X |
| 3,194,638 | 7/1965 | Neuville | 422/228 X |
| 3,822,999 | 7/1974 | Pope | 422/228 |
| 3,885,917 | 5/1975 | Osenkina et al. | 422/228 X |
| 3,990,948 | 11/1976 | Lindgren | 202/241 |
| 4,200,614 | 4/1980 | Colburn et al. | 422/228 X |

*Primary Examiner*—Richard L. Chiesa
*Attorney, Agent, or Firm*—Michael J. Striker

[57] ABSTRACT

An arrangement for discharging coke from a cooling shaft supplied with cooling gas, has one or several coke stripping members arranged to engage in a mass of coke discharged from the cooling shaft, a supporting element for supporting stripping members and rotating together with the latter, and a housing in which the supporting element together with the coke stripping member are accommodated and which is sealed from the atmosphere.

23 Claims, 2 Drawing Figures

ARRANGEMENT FOR DISCHARGING COKE FROM A COOLING SHAFT SUPPLIED WITH COOLING GAS

BACKGROUND OF THE INVENTION

The present invention relates to an arrangement for discharging coke from a cooling shaft supplied with cooling gas.

Arrangements for discharging coke from a cooling shaft supplied with cooling gas are known in the art. Known arrangements possess the disadvantages in the fact that the discharge of coke with the aid of these arrangements are not sufficiently controlled and are not uniform for the entire cross-section of the cooling shaft, on the one hand, and escape of dust-containing gas from the cooling shaft into the atmosphere is not reliably prevented, on the other hand.

SUMMARY OF THE INVENTION

Accordingly, it is an object of the present invention to provide an arrangement for discharging coke from a cooling shaft, which avoids the disadvantages of the prior art.

More particularly, it is an object of the present invention to provide an arrangement for discharging coke from a cooling shaft, which insures such a discharge of coke which is sufficiently controllable and uniform over the entire cross-section of the cooling shaft, on the one hand, and prevents escape of dust-containing gas into the atmosphere, on the other hand.

In keeping with these objects and with others which will become apparent hereinafter, one feature of the present invention resides in an arrangement for discharging coke from a cooling shaft supplied with cooling gas, which comprises at least one coke stripping member arranged to engage in a mass of coke discharged from a cooling shaft, a supporting element on which the coke stripping member is mounted and which is arranged rotatable together with the latter, and means for rotating the supporting element together with the coke stripping member, wherein housing means is provided in which the supporting elements together with the coke stripping member are accommodated and which is sealed from the atmosphere. A plurality of coke stripping members may be mounted on the supporting element. The means for rotating the supporting element together with the coke stripping member may include a speed adjustable rotary drive.

When the arrangement is designed in accordance with the present invention, it provides for a discharge system which is completely sealed from atmosphere and thereby reliably prevents escape of dust-containing gas from the system. The individual discharge elements which include a plurality of the stripping members mounted on the supporting element allow adjustment of the quantity of the discharge coke per time unit in desirable manner both by variation of the speed of rotation and the position of the stripping members. It can thereby be guaranteed that the coke column in the cooling shaft always has a constant height and the coke is always cooled with a constant intensivity.

In accordance with another advantageous features of the present invention, the coke stripping members can be mounted pivotally and/or longitudinally displaceably on the supporting element or supporting ring. When the arrangement is designed in accordance with this feature, the quantity of coke discharged by each individual stripping member can be exactly adjusted.

In accordance with still another feature of the present invention, the arrangement is provided with a coke collecting container arranged underneath a coke discharging table of the cooling shaft and adapted to collect the coke which is stripped from the coke discharging table by the coke stripping members. A locking container is located underneath the coke collecting container and locks the latter from below.

In accordance with a further advantageous feature of the present invention, the coke collecting container is provided with a cone-shaped raisable and lowerable bottom closure. By displacement of the bottom closure, the coke collecting container can be opened or closed so as to provide for or to interrupt the communication of the coke collecting container with the locking container.

Still a further advantageous feature of the present invention resides in that the collecting container which carries the discharge table serves simultaneously as a distributing chamber for a cooling gas inasmuch as it is connected with one or several cooling supply conduits. Advantageously, a common annular cooling gas supply conduit is arranged around the collecting container and connected with one another by branching conduits which extend radially inwardly from the annular conduit to the collecting container in a star-like manner.

An additional feature of the present invention is that the arrangement is provided with means for preventing discharge of cooling gas from the locking container into the atmosphere. This discharge preventing means may be formed by a suction conduit which communicates with the locking container and is arranged to draw off the cooling gas from the latter.

In accordance with another embodiment of the invention, the discharge preventing means may be formed as a conduit for supply of inert gas into the locking container, the inert gas having a pressure exceeding the pressure of the cooling gas.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
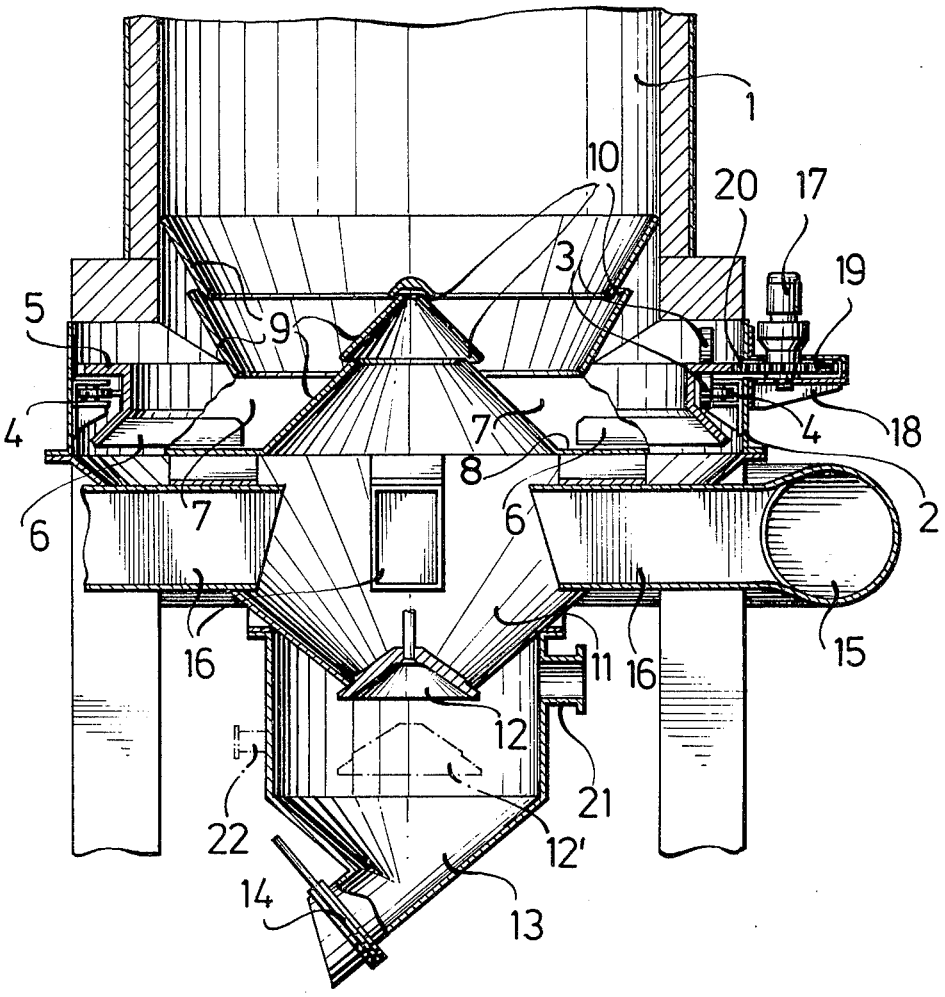
FIG. 1 of the drawing is a view showing a section of an arrangement for discharging coke from a cooling shaft, in accordance with the present invention and FIG. 2 of the drawing is a view substantially corresponding to the view of FIG. 1, but showing the arrangement in accordance with another embodiment of the invention.

An arrangement in accordance with the present invention is intended to discharge coke from a colling shaft having a lower region identified by reference numeral 1 in FIG. 1. The arrangement includes a housing 2 which may be constituted of metal and is connected with the lower region of the cooling shaft 1. A supporting ring 5 is supported on the housing 2 with the aid of vertical and horizontal bearing rollers and guiding rollers identified by reference numerals 3 and 4.

A plurality of stripping members 6 are mounted on the supporting ring 5 and engage in a chamber 7 into which the coke is discharged from the cooling shaft 1. In other words, the stripping members 6 engage in the coke pile accommodated in the chamber 7. The chamber 7 is formed above a discharge table 8. A plurality of frustoconical members 9 which may be constituted of metal are arranged one above the other so as to form a ring-shaped coke column in the discharge region of the cooling shaft 1. The discharge table 8 forms a lower closing portion of the members 9. Intermediate spaces 10 remain between the individual members 9 and serve for distributing the cooling gas.

Figure 2:
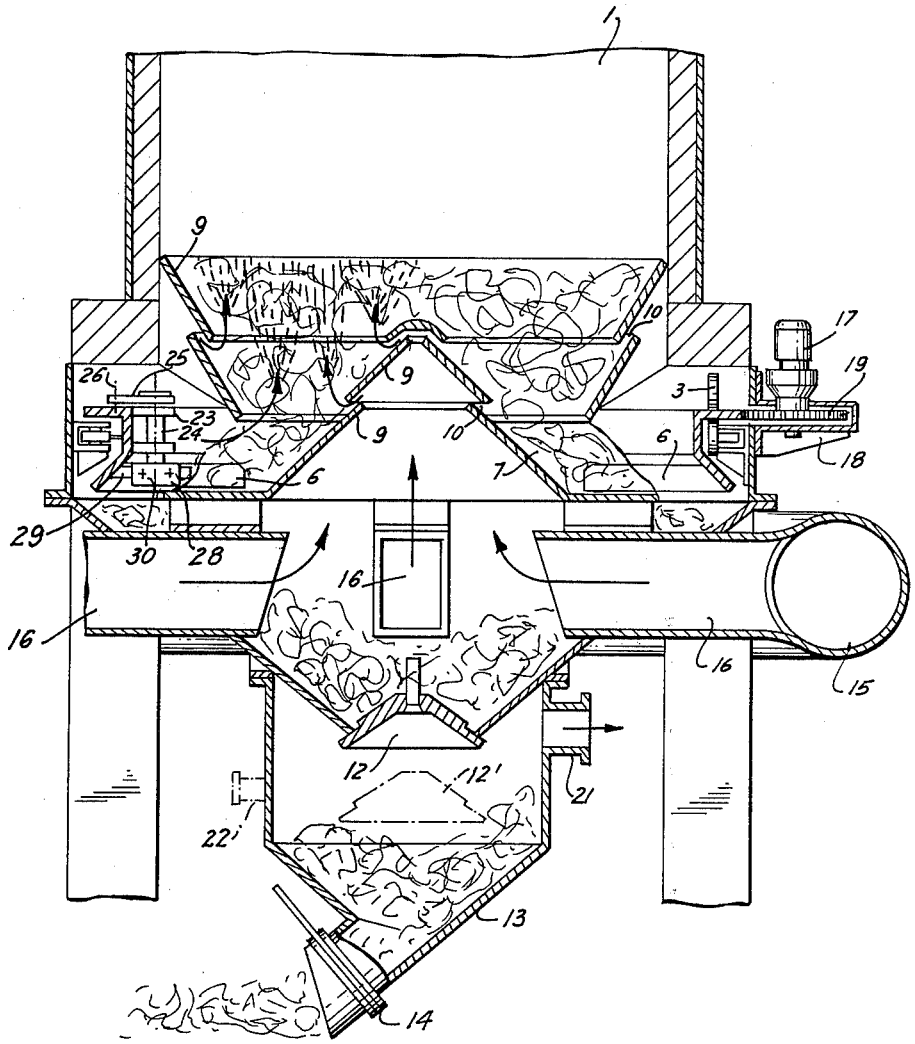

As can be seen from FIG. 1 of the drawing, the stripping members 6 are directly attached to the supporting ring 5. However, the stripping members 6 may be pivotally and/or longitudinally displaceably connected with the supporting ring 5. Such a construction is shown in FIG. 2. Each stripping member 6 is connected with a pin 24 which is pivotally supported in bearings 23. A turning lever 25 is connected with the pin 24 and utilized for turning the latter, whereby the stripping member 6 is also turned. The turning lever 25 is provided with a locking screw 26. A strip 29 is further mounted on the stripping member 6 and guided in a rail 28. Thereby the stripping member 6 can be displaced in longitudinal direction. Locking screws 30 act upon the strip 29 and fix the latter together with the stripping member 6 in desired position.

Turning now again to FIG. 1, it can be seen that a coke collecting container 11 is provided underneath the discharge table 8. The coke collecting container 11 serves for collecting the coke which is stripped by the stripping members 6. The coke collecting container 11 is provided with a cone shaped bottom closure 12 which is raisable and lowerable as identified by reference numeral 12'. A locking container 13 is located underneath and locked to the collecting container 11 from below. A shutter 14 is provided in the lower end portion of the locking container 13.

The coke collecting container 11 is radially outwardly surrounded by an annular conduit 15 for supply of the cooling gas. A plurality of branching conduits 16 extend from the annular conduit 11 radially inwardly toward the coke collecting container 11 and are open into the latter.

The cooling gas travels from the collecting container 11 through the coke resting on the discharge table 8 or through the above-mentioned intermediate spaces 10 into the cooling shaft 1. The cooling gas which travels in this upward stream flows around the coke accommodated in the cooling shaft and cools it down. After this, the cooling gas is drawn off from the upper region of the cooling shaft in not shown manner.

The supporting ring 5 is driven in rotation by a drive which in the illustrated embodiment includes an electric motor 17 mounted on the housing 1 by means of a supporting structure 18. The electric motor 17 drives a gear 19 which cooperates with a plurality of teeth 20 provided on the periphery of the supporting ring 5. The electric motor 7 may be a speed adjustable electric motor.

When the supporting ring 5 rotates, the stripping members 6 rotate together with the latter and remove the coke from the discharge table 8, which drops from the table into the collecting container 11. The withdrawal of the coke from the collecting container 11 into the locking container 13 and further withdrawal of the coke from the locking container 13 is performed by alternating opening and closing of the bottom closure 12 of the coke collecting container 11 and the shutter 14 of the locking container 13. This arrangement guarantees that in each operational phase a direct communication of the interior of the cooling shaft with the atmosphere cannot take place. Thereby, discharge of dust-containing gas from the cooling shaft or from the discharge system which can result in contamination of the surrounding atmosphere, is reliably prevented.

The locking container 13 is provided with a suction conduit identified by reference numeral 21. The cooling gas which flows into the locking container 13 in condition of the opened bottom closure 12 is drawn off through the suction conduit 21. Thereby, the cooling gas cannot escape into the atmosphere when the shutter 14 is open.

The escape of the cooling gas from the locking container 13 can be prevented in somewhat different manner. As shown in dotted lines in the drawing, the locking container 13 is provided with a conduit 22 through which an inert gas can be supplied into the locking container 13. The inert gas must have a pressure which is higher than the pressure of the cooling gas, so that when the bottom closure 12 is open, the cooling gas cannot flow into the locking container 13.

When the coke is discharged from the coke collecting container 11, that is when the bottom closure 12 is open, the rotation of the supporting ring 5 with the stripping member 6 is stopped. Thereby, during this time no additional amount of coke is supplied into the coke collecting container 11 and clogs the bottom closure 12 of the latter.

It will be understood that each of the elements described above, or two or more together, may also find a useful application in other types of constructions differing from the types described above.

While the invention has been illustrated and described as embodied in an arrangement for discharging coke from a cooling shaft, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for discharging coke from a cooling shaft supplied with cooling gas and having an outlet region, the arrangement comprising housing means arranged to be located adjacent to the outlet region of the cooling shaft and sealed from atmosphere; a supporting element accomodated rotatable in said housing means; at least one coke stripping member also accommodated in said housing means and arranged to engage in a mass of coke discharged from the cooling shaft, said coke stripping member being mounted on said supporting element for joint rotation therewith; and means for rotating said supporting element together with said coke stripping member.

2. An arrangement as defined in claim 1; and further comprising at least one further such coke stripping member which is also mounted on said supporting element.

3. An arrangement as defined in claim 1, wherein said supporting element is ring-shaped.

4. An arrangement as defined in claim 1, wherein said means for rotating said supporting element together with said coke stripping member includes a speed adjustable rotary drive.

5. An arrangement as defined in claim 1, wherein said coke stripping member is pivotally mounted on said supporting element.

6. An arrangement as defined in claim 1, wherein said coke stripping member is longitudinally displaceably mounted on said supporting element.

7. An arrangement as defined in claim 1, wherein said coke stripping member is pivotally and longitudinally displaceably mounted on said supporting element.

8. An arrangement as defined in claim 1; and further comprising means for supporting the mass of coke discharged from the cooling shaft, and means for collecting coke which is stripped from said coke supporting means by said stripping member.

9. An arrangement as defined in claim 8, wherein said coke supporting means includes a coke discharging table, said coke collecting means including a coke collecting container arranged underneath said coke discharging table.

10. An arrangement as defined in claim 9; and further comprising a locking container arranged underneath said coke collecting container and locking the latter from below.

11. An arrangement as defined in claim 10, wherein said coke collecting container is provided with a bottom closure which is openable and closable so as to connect said coke collecting container with or disconnect the same from said locking container, respectively.

12. An arrangement as defined in claim 11, wherein said bottom closure of said coke collecting container is cone-shaped.

13. An arrangement as defined in claim 9; and further comprising means for feeding cooling gas into the mass of coke, said cooling gas feeding means communicating with said coke collecting container so that the cooling gas is fed into the latter, whereby said coke collecting container serves simultaneously as a cooling gas distributing chamber.

14. An arrangement as defined in claim 13, wherein said cooling gas feeding means includes a plurality of individual cooling gas supply conduits which are connected with a source of the cooling gas and commmunicate with said coke collecting container.

15. An arrangement as defined in claim 14, wherein said cooling gas feeding means also includes a common annular cooling gas supply conduit which radially outwardly surrounds said coke collecting container, said individual cooling gas supply conduits extending radially inwardly from said common cooling gas supply conduit toward said coke collecting container in a starlike manner.

16. An arrangement as defined in claim 10; and further comprising means for preventing discharge of the cooling gas from said coke collecting container into atmosphere.

17. An arrangement as defined in claim 16, wherein said cooling gas discharge preventing means includes means for drawing off the cooling gas from said coke collecting container.

18. An arrangement as defined in claim 17, wherein said cooling gas drawing off means includes a suction conduit communicating with said coke collecting container.

19. An arrangement as defined in claim 16, wherein said cooling gas has a predetermined pressure, said cooling gas discharge preventing means including means for supplying into said coke collecting container inert gas with a pressure exceeding the pressure of the cooling gas.

20. An arrangement as defined in claim 19, wherein said inert gas supplying means includes an inert gas supply conduit communicating with said coke collecting container.

21. An arrangement for discharging coke from a cooling shaft supplied with cooling gas and having an outlet region, the arrangement comprising housing means arranged to be located adjacent to the outlet region of the cooling shaft and sealed from atmosphere; a ring-shaped supporting element accommodated rotatable in said housing means; at least one coke stripping member also accommodated in said housing means and arranged to engage in a mass of coke discharged from the cooling shaft, said coke stripping member being mounted on said supporting element for joint rotation therewith; and means for rotating said supporting element together with said coke stripping member and including a speed-adjustable rotary drive.

22. An arrangement for discharging coke, comprising a cooling shaft supplied with cooling gas and having an outlet region; housing means located adjacent to said outlet region of said cooling shaft and sealed from atmosphere; a supporting element accommodated rotatable in said housing means; at least one coke stripping member also accommodated in said housing means and arranged to engage in a mass of coke discharged from the cooling shaft, said coke stripping member being mounted on said supporting element for joint rotation therewith; and means for rotating said supporting element together with said coke stripping member.

23. An arrangement for discharging coke, comprising a cooling shaft supplied with cooling gas and having an outlet region; housing means located adjacent to said outlet region of said cooling shaft and sealed from atmosphere; a ring-shaped supporting element accommodated rotatable in said housing means; at least one coke stripping member also accommodated in said housing means and arranged to engage in a mass of coke discharged from the cooling shaft, said coke stripping member being mounted on said supporting element for joint rotation therewith; and means for rotating said supporting element together with said coke stripping member and including a speed-adjustable rotary drive.

* * * * *